US008564612B2

(12) United States Patent
Dyke et al.

(10) Patent No.: US 8,564,612 B2
(45) Date of Patent: Oct. 22, 2013

(54) DEEP PIXEL PIPELINE

(75) Inventors: Kenneth Dyke, Sunnyvale, CA (US); Assana Fard, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 641 days.

(21) Appl. No.: 11/462,486

(22) Filed: Aug. 4, 2006

(65) Prior Publication Data

US 2008/0030520 A1 Feb. 7, 2008

(51) Int. Cl.
*G09G 5/02* (2006.01)

(52) U.S. Cl.
USPC ..... 345/605

(58) Field of Classification Search
USPC ..... 345/605
See application file for complete search history.

(56) References Cited

U.S. PATENT DOCUMENTS

| | | | | |
|---|---|---|---|---|
| 5,777,624 | A * | 7/1998 | Munson | 345/605 |
| 6,369,830 | B1 * | 4/2002 | Brunner et al. | 345/629 |
| 2005/0285867 | A1 * | 12/2005 | Brunner et al. | 345/537 |
| 2007/0009060 | A1 * | 1/2007 | Lavelle et al. | 375/295 |

OTHER PUBLICATIONS

Matrox Parhelia, "10-bit GigaColor Technology," May 14, 2002, 9-pgs.
Andy Ritger, "An Overview of the NVIDIA UNIX Graphics Driver," nVIDIA Corporation, Feb. 8, 2006, 12-pgs.

* cited by examiner

*Primary Examiner* — Aaron M Richer
(74) *Attorney, Agent, or Firm* — Wong, Cabello, Lutsch, Rutherford & Brucculeri LLP

(57) ABSTRACT

In a pixel imaging method and system, pixel information is stored into backing stores in system memory of a computer. A graphics processing unit (GPU) composites the pixel information into a first assembly buffer that has a first color depth of at least greater than 8-bits per color component. The GPU dithers and filters the pixel information in the first assembly buffer into a second assembly buffer. The second assembly buffer has a second color depth that is different from the first color depth of the first assembly but is the same as the color depth of the computer's frame buffer. The GPU copies the pixel information from the second assembly buffer into the frame buffer (optionally modifying them such as, by filtering), and scan-out hardware outputs the pixel information in the frame buffer to a display of the computer.

27 Claims, 4 Drawing Sheets

DEEP PIXEL PIPELINE

FIELD OF THE DISCLOSURE

The subject matter of the present disclosure relates to a deep pixel pipeline for a computer system that has a depth of greater than 8-bits for each color component.

BACKGROUND OF THE DISCLOSURE

A pixel pipeline refers to elements of a computer windowing system that process pixel information for display. In FIG. 1, a pixel pipeline 100 according to the prior art for a computer windowing system is schematically illustrated. The prior art pipeline 100 includes a Graphics Processing Unit (GPU) 110, system memory 102, Video Random Access Memory (VRAM) 104, and output hardware 106, which are all components of the computer system. Typically, VRAM refers to any kind of random access memory (regardless of the actual type) that is coupled directly to the GPU so it can be accessed quickly (typically in an arrangement that makes VRAM much faster for the GPU to access than a Central Processing Unit (CPU)).

The system memory 102 has backing stores 120 and 122, and the VRAM has an assembly buffer 130. The output hardware 106 includes a frame buffer 140, scan-out hardware 150, and a display panel 160. As is known in the art, the backing stores 120 and 122 receive information from applications and the operating system of the computer system. The frame buffer 140 holds the complete bit-mapped image that is eventually sent to the display 160 by the scan-out hardware 150.

In the art, pixels can be stored with various color depths, including 1-bit monochrome, 4-bit palletized, 8-bit palletized, 16-bit Highcolor, and 24-bit Truecolor, for example. An additional alpha component can also be used for pixel transparency. In 24-bit Truecolor, for example, each of the color components Red, Green, and Blue is represented by 8-bits in the RGB color space so that the color depth for the pixel is represented by a total of 24-bits. Each color component Red, Green, and Blue has $2^8$ or 256 levels of color and can be combined to give a total of 16,777,216 mixed colors (256×256×256).

To display images on the display panel 160 with the prior art pixel pipeline 100, the operating system and applications of the computer system store pixel information in the backing stores 120, 122. Typically, the operating system and applications use only 8-bits per component for the pixel information, and the backing stores 120 and 122 are configured to store only 8-bits per component. The GPU 110 composites the pixel information stored in the backing stores 120 and 122 into an assembly buffer 130 of the VRAM 104. When compositing, the GPU 110 formats the pixel information in the same eventual format of the frame buffer 140 Typically, the frame buffer 140 is configured for 8-bits per component, although graphics cards are known in the art that offer greater than 8-bit frame buffers.

The prior art pixel pipeline 100 for the computer windowing system handles pixel information with less accuracy due to the low color depth available for the compositing and processing of pixel information for display 160. The subject matter of the present disclosure is directed to overcoming or at least reducing this and other limitations associated with the prior art pixel pipeline.

SUMMARY OF THE DISCLOSURE

A pixel imaging method and system for a computer is disclosed. In addition, a programmable storage device can have program instructions stored thereon for causing a programmable control device to perform the pixel imaging method disclosed herein. In one embodiment, pixel information from one or more processes is stored into one or more backing stores in system memory of the computer. A graphics processing unit composites the pixel information from the one or more backing stores into a first assembly buffer. The first assembly buffer has a first color depth of at least greater than 8-bits per color component. In one embodiment, for example, the first color bit depth is 16-bits per color component. The graphics processing unit processes the pixel information in the first assembly buffer into a second assembly buffer. The second assembly buffer has a second color depth different from the first color depth. In one embodiment, the second color depth is from 10 to 15-bits per color component. Processing by the graphics processing unit can include dithering and filtering of the pixel information from the first assembly buffer into the second assembly buffer. The graphics processing unit copies the pixel information from the second assembly buffer into a frame buffer of the computer. The color depth of the second assembly buffer is equal to the color depth of the frame buffer. Scan-out hardware outputs the pixel information in the frame buffer to a display of the computer.

The foregoing summary is not intended to summarize each potential embodiment or every aspect of the present disclosure.

BRIEF DESCRIPTION OF THE DRAWINGS

The foregoing summary, preferred embodiments, and other aspects of subject matter of the present disclosure will be best understood with reference to a detailed description of specific embodiments, which follows, when read in conjunction with the accompanying drawings, in which.

Figure 1:
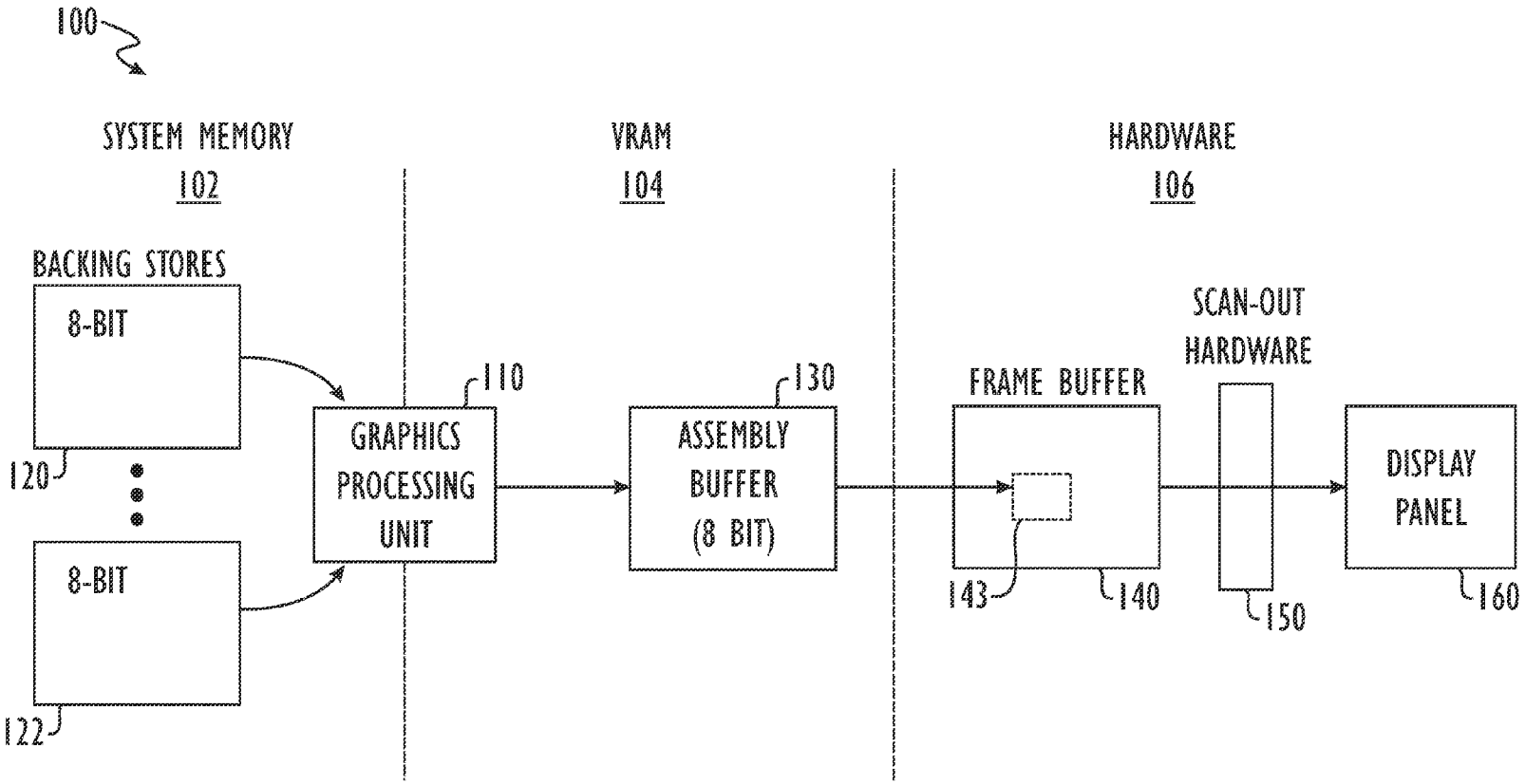
FIG. 1 (Prior Art)
FIG. 1 schematically illustrates a pixel pipeline according to the prior art for a computer system.

While the subject matter of the present disclosure is susceptible to various modifications and alternative forms, specific embodiments thereof have been shown by way of example in the drawings and are herein described in detail. The figures and written description are not intended to limit the scope of the inventive concepts in any manner. Rather, the figures and written description are provided to illustrate the inventive concepts to a person skilled in the art by reference to particular embodiments, as required by 35 U.S.C. §112.

DETAILED DESCRIPTION

Figure 2:
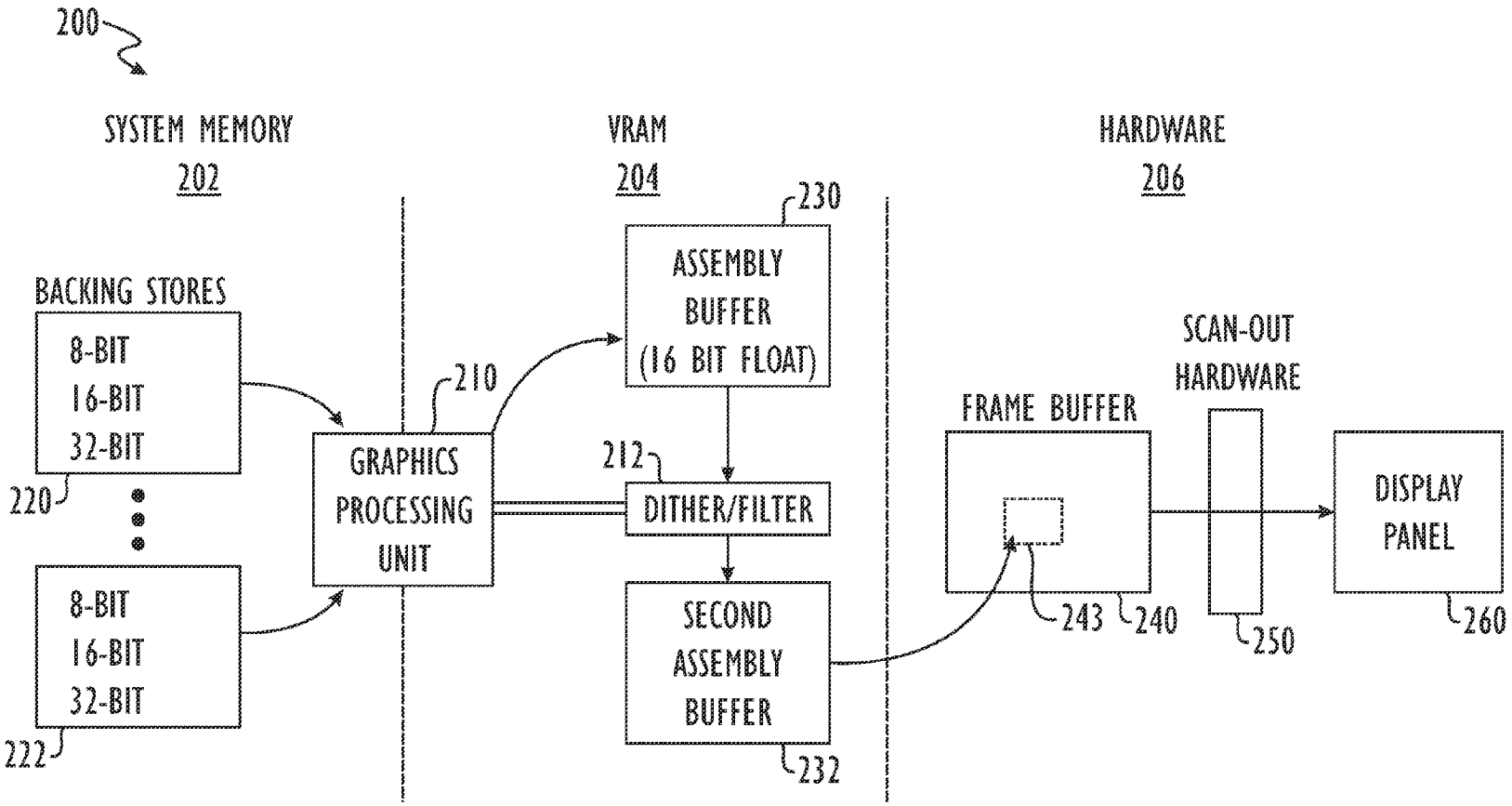
FIG. 2 schematically illustrates a deep pixel pipeline according to certain teachings of the present disclosure for a computer system.

Referring to FIG. 2, a deep pixel pipeline 200 according to the present disclosure is schematically illustrated. The pipeline 200 includes a system memory 202, a Video Random Access Memory (VRAM) 204, hardware 206, and a Graphics Processing Unit (GPU) 210, which are all part of a computer system. The display output hardware 206 of the pipeline 200 includes a frame buffer 240, scan-out hardware 250, and a display panel 260. Preferably, the VRAM 204 is random access memory directly coupled to the GPU 210 so it can be accessed quickly.

The system memory 202 has a plurality of backing stores 220 that store pixel information for display. In the present embodiment, the backing stores 220 are configured for a depth of 8-bits and greater (e.g., 8-bits, 16-bits, 32-bits, etc.) per component of pixel information. As noted previously, prior art backing stores (i.e., elements 120 and 122 in FIG. 1) are typically configured for a depth of only 8-bits per component of pixel information.

The GPU 210 is a graphics processor, which can be programmable or non-programmable. The GPU 210 can generate graphics effects without placing load on a central processing unit (CPU, not shown) of the computer system and can offer enhanced speed for graphics calculations. Additional details of the GPU 210 are known in the art and are not discussed in detail herein.

In VRAM 204, the pipeline 200 has a first assembly buffer 230, dithering and filtering processes 212, and a second assembly buffer 232. The first assembly buffer 230 is configured for a depth of at least greater than 8-bits per component. Thus, for a pixel in the RGB color space, each of the color components of Red, Green, and Blue is represented by at least greater than 8-bits so that the color for the pixel is represented by more than 24-bits total. In one embodiment, the first assembly buffer 230 is configured for at least 16-bits or greater (e.g., 32-bits) per color component. The pixel information can also include an alpha component for indicating transparency.

The second assembly buffer 232 is configured for the same format and depth per color component as the frame buffer 240 of the pipeline 200. The frame buffer 240 and the other elements of display output hardware 206 are configured for at least 8-bits per component of pixel information or greater. In one embodiment, the frame buffer 240 can provide between 10 to 15 bits per component. For example, the frame buffer 240 can have a format and depth of 2:10:10:10 in one embodiment. Here, the depth of the pixels is 10-bits per color component and 2-bits for an alpha component of transparency.

Figure 3:
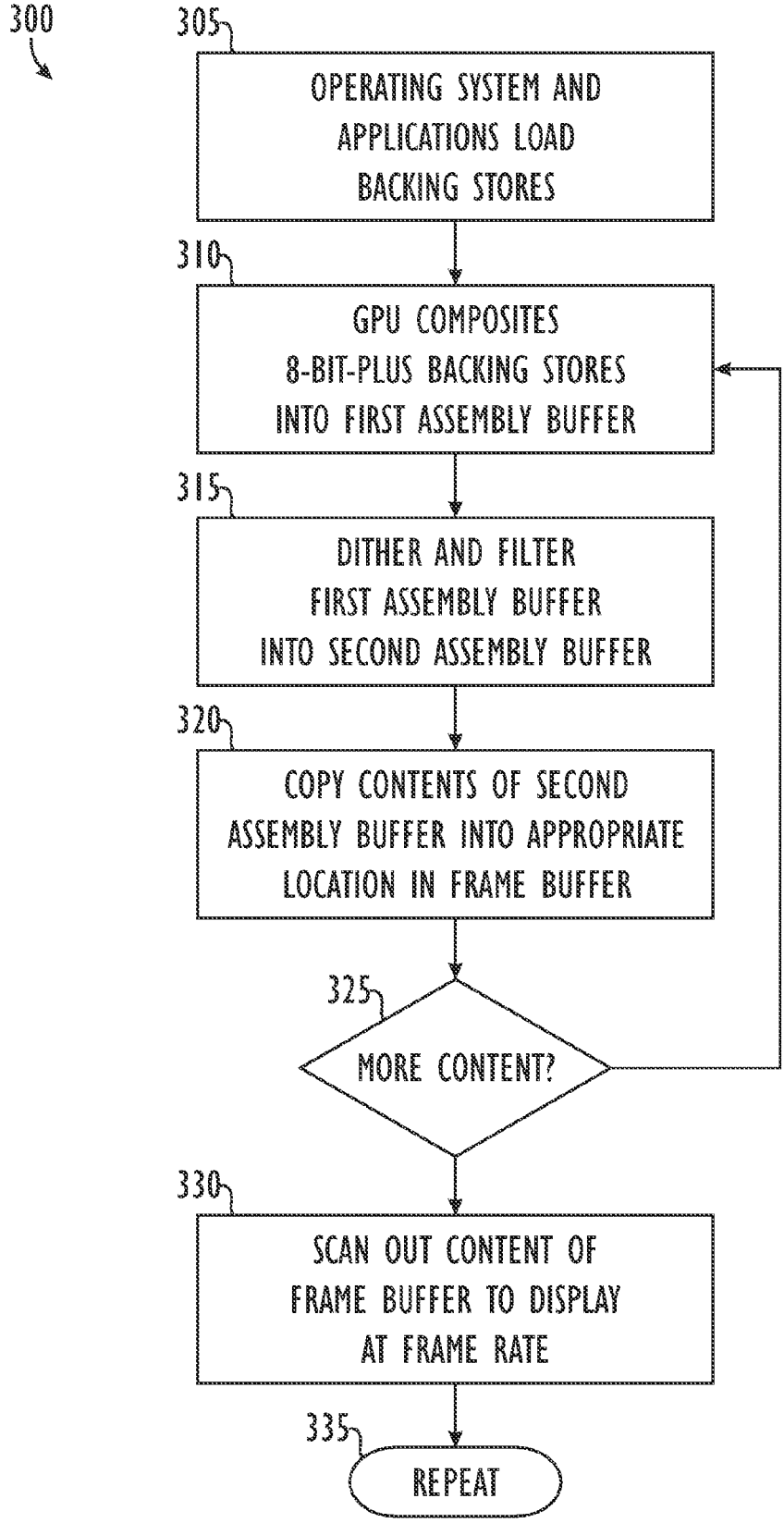
FIG. 3 illustrates a process of operating the deep pixel pipeline of FIG. 2 in flow chart form.

Given the above overview of the pipeline 200 in FIG. 2, we now turn to FIG. 3 to discuss an embodiment of the operating process of the pipeline 200. In the discussion that follows, reference is concurrently made to element numerals for the components of the FIG. 2. As shown in flow chart form of FIG. 3, the operating process 300 of the pipeline 200 begins with external processes (e.g., the operating system and applications) loading the backing stores 220 of the system memory 202 with pixel information (Block 305). As noted previously, the backing stores 220 are configured to hold pixel information having a color depth of 8-bits and greater (e.g., 8-bits, 16-bits, 32-bits, etc.) per component.

The GPU 210 composites the pixel information from the backing stores 220 and 222 into the first, high fidelity assembly buffer 230 configured for greater than 8-bits per components (e.g., at least 16-bits per component) (Block 310). This first assembly buffer 230 is subsequently dithered and filtered into the second assembly buffer 232 using the dithering and filtering process 212 of the GPU 210 (Block 315). As noted previously, the second assembly buffer 232 has the same format and depth per component as the system's frame buffer 240.

The pixel information of the second assembly buffer 232 is then copied into the appropriate location in the system's display-wide frame buffer 240 (Block 320). For example, the contents of the second assembly buffer 232 can be flushed (blitted) to the frame buffer 240 at the beam sync rate of the display panel 260. As the frame buffer 240 is filled, the process 300 determines whether more pixel information is to be input into the display-wide frame buffer 240 (Block 325) and returns to earlier processing steps of Block 320 if so. If the frame buffer 240 is ready, the scan-out hardware 250 delivers the contents of the frame buffer 240 to the display panel 260 of the computer system (Block 330). Like the frame buffer 240, the scan-out hardware 250 is also capable of providing greater than 8-bits (e.g., 10 to 15-bits) per component. When outputting the contents, the scan-out hardware 250 can perform temporal dithering. The operating process 300 can then be repeated to construct the next frame for display.

In one benefit of the pipeline 200 of FIG. 2, having the GPU 210 composite pixel information from the backing stores 220 into the first assembly buffer 230 configured for greater than 8-bit depth allows the various composite operations to be performed at higher levels of fidelity. By later dithering and filtering pixel information from the first assembly buffer 230 to the lower depth of the second assembly buffer 232, the high fidelity compositing that occurs in the first assembly buffer 230 is performed before dithering the contents down to the appropriate depth configured for the frame buffer 240.

The GPU 210 can perform various filter operations in the dithering and filtering process 212 on the pixel information between the first and second assembly buffers 230 and 232. For example, some filter operations include: (1) spatial dithering to reduce component bit depth; (2) high dynamic tone mapping to mimic small bright object behavior; (3) color conversion; and (4) spatial correction for non-uniform illumination of the display panel 260. The filter operations can use dithering techniques that attempt to approximate a particular color of one pixel in an image by juxtaposing less deep colors in adjacent pixels in the image. The filter operation can use tone mapping techniques to map the pixel data having a high dynamic range (HER) to a less dynamic range that is more compatible with the computer's display panel 260.

The filter operations can be implemented by various fragment programs. The name "fragment" program derives from the fact that a unit of data being operated upon is generally a pixel—i.e., a fragment of an image. The GPU 210 can run a fragment program on several pixels simultaneously to create a result in the second assembly buffer 232.

Figure 4:
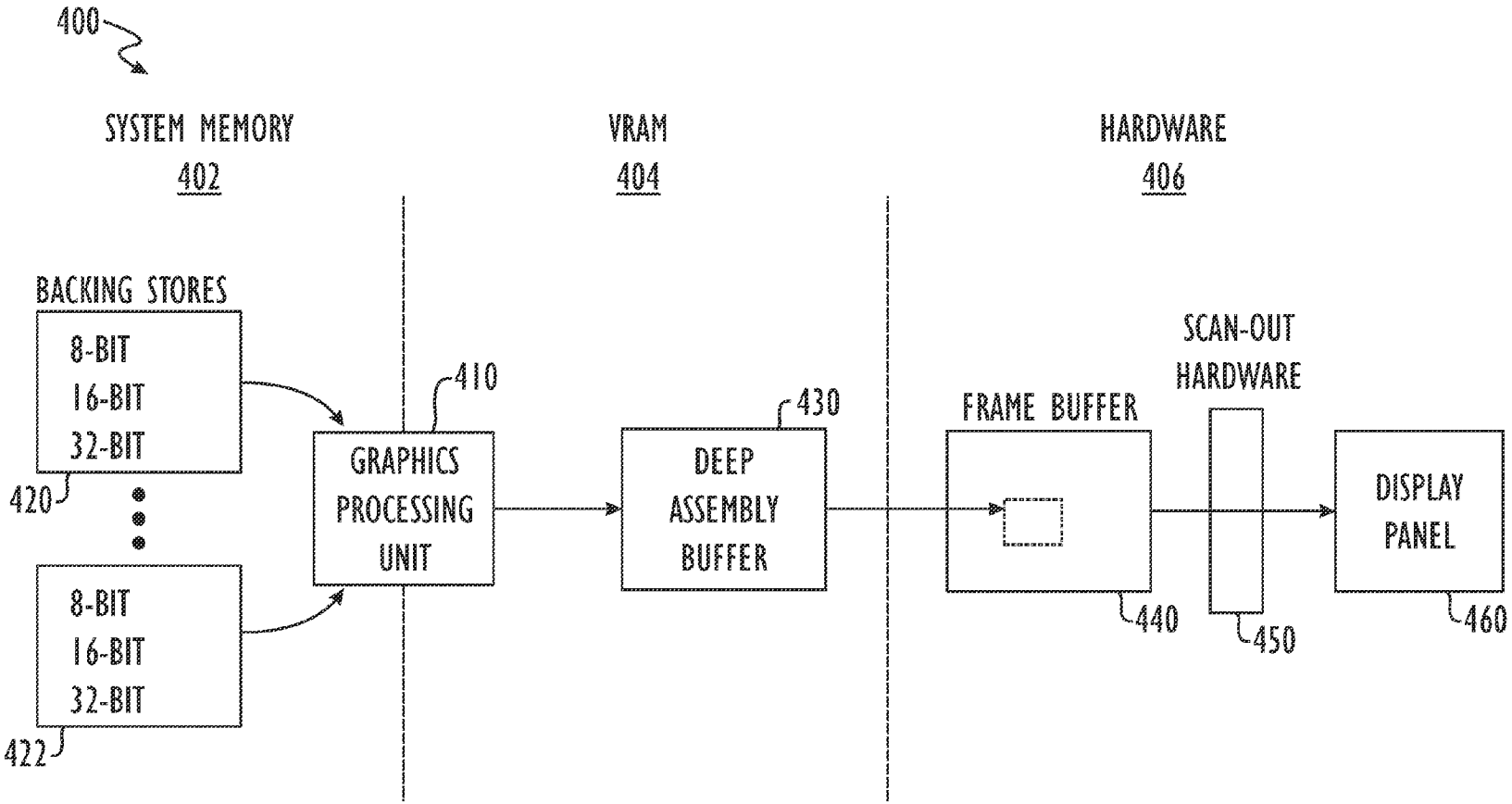
FIG. 4 schematically illustrates another embodiment of a deep pixel pipeline according to certain teachings of the present disclosure for a computer system.

Although the present embodiment includes first and second assembly buffers 230 and 232 having different color depth per component, an alternative embodiment can include only one assembly buffer. Referring to FIG. 4, another embodiment of a deep pixel pipeline 400 according to the present disclosure is schematically illustrated. As before, the pipeline 400 includes a system memory 402, a Virtual Random Access Memory (VRAM) 404, hardware 406, and a Graphics Processing Unit (GPU) 410. The system memory 402 has a plurality of backing stores 420 and 422 that store pixel information for display. In the present embodiment, the backing stores 420 and 422 are configured for a depth of 8-bits and greater (e.g., 8-bits, 16-bits, 32-bits, etc.) per component of pixel information.

The display output hardware 406 of the pipeline 400 includes a frame buffer 440, scan-out hardware 450, and a display panel 460 as before. The frame buffer 440 and the other display output hardware 406 are configured for greater than 8-bits per component. In one embodiment, the frame buffer 440 can provide between 10 and 15 bits per component, and the frame buffer 440 can have a format and depth of 2:10:10:10.

In VRAM 404, the pipeline 400 has a deep pixel depth assembly buffer 430. As before, this assembly buffer 430 is configured for a depth of at least greater than 8-bits per component. However, in the present embodiment, the assembly buffer 430 is configured for the same depth as the frame buffer 440 of the system's hardware 406. For example, if the frame buffer 440 is configured for 10-bits per component, the assembly buffer 430 is also configured for 10-bits per component. Because the one assembly buffer 430 has a greater depth per component, the GPU 410 can perform compositing and other operations on the pixel information in this buffer 430 at a higher fidelity than is provided by 8-bit prior art systems. For example, the GPU 410 can perform dithering and filter operations. In addition, the pixel information in the one assembly buffer 430 can be copied into the frame buffer 440 having the same depth per component so that the GPU 410 does not need to perform any dithering to reduce the depth per component before copying the pixel information into the frame buffer 440.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A pixel imaging method for a computer system, comprising:

receiving at least first and second pixel information from one or more application backing stores;

compositing the at least first and second pixel information with a graphics processing unit (GPU) by combining the at least first and second pixel information into a first assembly buffer as composited pixel information, the first assembly buffer having a first color depth of at least greater than 8-bits per color component, wherein the act of compositing comprises a graphical blending technique applied to the first and second pixel information and wherein the GPU comprises a processing unit configured to execute fragment programs on several pixels simultaneously;

processing the composited pixel information in the first assembly buffer into a second assembly buffer as processed pixel information, the second assembly buffer having a second color depth, the second color depth being different from the first color depth;

copying the processed pixel information from the second assembly buffer into a frame buffer of the computer system as output pixel information, the second color depth being equal to a third color depth of the frame buffer; and outputting the output pixel information in the frame buffer for display with the computer system.

2. The method of claim 1, wherein the act of receiving at least first and second pixel information from one or more application backing stores comprises receiving the at least first and second pixel information at a color depth equal to or greater than 8-bits per color component.

3. The method of claim 1, wherein the act of processing the composited pixel information from the first assembly buffer into the second assembly buffer comprises performing a filter operation on the composited pixel information.

4. The method of claim 3, wherein the filter operation is selected from the group consisting of: spatial dithering to reduce component bit depth, high dynamic tone mapping to mimic small bright object behavior, color conversion, blending, and spatial correction for non-uniform display panel illumination.

5. The method of claim 1, wherein the act of processing the composited pixel information in the first assembly buffer into the second assembly buffer comprises dithering the first color depth of the composited pixel information in the first assembly buffer to the second color depth of the second assembly buffer.

6. The method of claim 1, wherein the first color depth of the first assembly buffer is greater than or equal to 16-bits per color component.

7. The method of claim 6, wherein the second color depth of the second assembly buffer is from 10 to 15-bits per color component.

8. The method of claim 7, wherein the second color depth further comprise an alpha component for transparency that is 2-bits.

9. A non-transitory programmable storage device having program instructions stored thereon for causing a programmable control device to perform a pixel imaging method, comprising:

receiving at least first and second pixel information from one or more application backing stores;

compositing the at least first and second pixel information with a graphics processing unit (GPU) by combining the at least first and second pixel information into a first assembly buffer as composited pixel information, the first assembly buffer having a first color depth of at least greater than 8-bits per color component, wherein the act of compositing comprises a graphical blending technique applied to the first and second pixel information and wherein the GPU comprises a processing unit configured to execute a fragment program on several pixels simultaneously;

processing the composited pixel information in the first assembly buffer into a second assembly buffer as processed pixel information, the second assembly buffer having a second color depth, the second color depth being different from the first color depth;

copying the processed pixel information from the second assembly buffer into a frame buffer of the computer system as output pixel information, the second color depth being equal to a third color depth of the frame buffer; and outputting the output pixel information in the frame buffer for display with the computer system.

10. The programmable storage device of claim 9, wherein the act of receiving at least first and second pixel information from one or more application backing stores comprises receiving the at least first and second pixel information at a color depth equal to or greater than 8-bits per color component.

11. The programmable storage device of claim 9, wherein the act of processing the composited pixel information from the first assembly buffer into the second assembly buffer comprises performing a filter operation on the composited pixel information.

12. The programmable storage device of claim 11, wherein the filter operation is selected from the group consisting of: spatial dithering to reduce component bit depth, high dynamic tone mapping to mimic small bright object behavior, color conversion, blending, and spatial correction for non-uniform display panel illumination.

13. The programmable storage device of claim 9, wherein the act of processing the composited pixel information in the first assembly buffer into the second assembly buffer comprises dithering the first color depth of the composited pixel information in the first assembly buffer to the second color depth of the second assembly buffer.

14. The programmable storage device of claim 9, wherein the first color depth of the first assembly buffer is greater than or equal to 16-bits per color component.

15. The programmable storage device of claim 14, wherein the second color depth of the second assembly buffer is from 10 to 15-bits per color component.

16. The programmable storage device of claim 15, wherein the second color depth further comprise an alpha component for transparency that is 2-bits.

17. A computer system, comprising:

a first assembly buffer for storing pixel information having a first color depth of at least greater than 8-bits per color component;

a second assembly buffer for storing pixel information having a second color depth different from the first color depth;

a frame buffer for storing pixel information having the same second color depth as the second assembly buffer; and a graphics processing unit (GPU), the GPU capable of executing a fragment program on several pixels simultaneously and configured to composite at least first and second pixel information from one or more application backing stores to combine the at least first and second pixel information into the first assembly buffer as composited pixel information, the composited pixel information a result of a graphical blending operation, and process the composited pixel information in the first assembly buffer into the second assembly buffer as processed pixel information; and copy the processed pixel information from the second assembly buffer into the frame buffer.

18. The system of claim 17, wherein the application backing stores are configured to store pixel information at a color depth equal to or greater than 8-bits per color component.

19. The system of claim 17, wherein to process the composited pixel information in the first assembly buffer into the second assembly buffer, the graphics processing unit is configured to perform a filter operation on the composited pixel information.

20. The system of claim 19, wherein the filter operation is selected from the group consisting of: spatial dithering to reduce component bit depth, high dynamic tone mapping to mimic small bright object behavior, color conversion, and spatial correction for non-uniform display panel illumination.

21. The system of claim 17, wherein to process the composited pixel information in the first assembly buffer into the second assembly buffer, the graphics processing unit is configured to dither the first color depth of the composited pixel information in the first assembly buffer to the second color depth of the second assembly buffer.

22. The system of claim 17, wherein the first color depth of the first assembly buffer is greater than or equal to 16-bits per color component.

23. The system of claim 22, wherein the second color depth of the second assembly buffer is from 10 to 15-bits per color component.

24. The system of claim 23, wherein the second color depth further comprise an alpha component for transparency that is 2-bits.

25. A pixel imaging method for a computer system, comprising:

receiving at least first and second pixel information from one or more application backing stores;

compositing the at least first and second pixel information with a graphics processing unit (GPU) by combining the at least first and second pixel information into a first assembly buffer as composited pixel information, the first assembly buffer having a first color depth of at least greater than 8-bits per color component, wherein the act of compositing comprises a graphical blending technique applied to the first and second pixel information and wherein the GPU comprises a processing unit configured to execute a fragment program on several pixels simultaneously;

copying the composited pixel information from the first assembly buffer into a frame buffer of the computer system as output pixel information, the first color depth of the first assembly buffer being equal to a second color depth of the frame buffer; and outputting the output pixel information in the frame buffer for display with the computer system.

26. The method of claim 25, wherein the act of receiving at least first and second pixel information from one or more application backing stores comprises receiving the at least first and second pixel information at a color depth equal to or greater than 8-bits per color component.

27. The method of claim 25, wherein the first and second color depths are at least greater than or equal to 10-bits per color component.

* * * * *

UNITED STATES PATENT AND TRADEMARK OFFICE

CERTIFICATE OF CORRECTION

PATENT NO. : 8,564,612 B2
APPLICATION NO. : 11/462486
DATED : October 22, 2013
INVENTOR(S) : Dyke et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 765 days.

Signed and Sealed this
Seventh Day of April, 2015

Michelle K. Lee

Michelle K. Lee
*Director of the United States Patent and Trademark Office*